United States Patent [19]

Wheeler

[11] Patent Number: 4,898,297

[45] Date of Patent: Feb. 6, 1990

[54] DETACHABLE HANDLE AND COASTER FOR A BEVERAGE CONTAINER

[76] Inventor: Charles L. Wheeler, 1912 - 13th St. South, St. Cloud, Minn. 56301

[21] Appl. No.: 293,803

[22] Filed: Jan. 5, 1989

Related U.S. Application Data

[63] Continuation-in-part of Ser. No. 168,460, Mar. 15, 1988, abandoned.

[51] Int. Cl.[4] ..... B65D 25/28

[52] U.S. Cl. ..... 220/85 H

[58] Field of Search ..... 220/85 H

[56] References Cited

U.S. PATENT DOCUMENTS 2,088,387 7/1937 Rice ..... 220/85 H
2,990,998 4/1961 Barclay ..... 220/356
3,013,691 12/1961 Prentice ..... 220/85 H
3,029,975 4/1962 Aiello ..... 220/85 H

FOREIGN PATENT DOCUMENTS 7402056 8/1975 Netherlands ..... 220/85 H

*Primary Examiner*—George E. Lowrance
*Attorney, Agent, or Firm*—Herman H. Bains

[57] ABSTRACT

A single-piece coaster and handle device molded from plastic material for ready attachment to and removal from a conventional beverage can includes a generally circular coaster structure and a generally C-shaped handle. The C-shaped handle includes a slotted upper handle element having a plurality of gripping projections for engaging the upper bead of a beverage can. A rectangular support element is integral with the lower handle element of the C-shaped handle.

1 Claim, 1 Drawing Sheet

DETACHABLE HANDLE AND COASTER FOR A BEVERAGE CONTAINER

BACKGROUND OF THE INVENTION

This Application is a Continuation-In-Part Application of my co-pending Application Ser. No. 168,460, entitled DETACHABLE HANDLE FOR A BEVERAGE CONTAINER, filed Mar. 15, 1988 abandoned.

Various beverages and juices are sold in metal cans, which are provided with quick opening tabs. Many consumers drink the beverage directly from the can, and most beverage cans are chilled, which often times results in sweating of the exterior of the can. Fabric coaster jackets, or other coaster devices, are often used directly with the cans by some consumers because of the tendency of the chilled metal cans to sweat.

Certain prior art handle devices have been developed for detachable application to beverage cans to facilitate drinking from the can. For example, the DeMars Patent, U.S. Pat. No. 4,602,723, discloses a handle for a beverage can, which clips to the upper and lower beads of the can, and which has a recessed end for engaging the pull tab for the can.

The Aiello Patent, U.S. Pat. No. 3,029,975, discloses a can handle stamped from metal, which includes a base portion for supporting the bottom wall of the can, and an upper portion, which clips over the upper bead of the can.

The Arnaud Patent, U.S. Pat. No. 3,825,151, discloses a detachable handle for cans, which includes a lower annular flange for supporting the base of the can, and an upper claw element, which engages the bead of the can. A vertical handle is fastened to the base and to the claw element of the handle structure.

The Geen Patent, U.S. Pat. No. 2,801,743, discloses a container handling device, which supports the base of a container, such as a metal can, and which either embraces the body of the container or clips over the upper bead of the container.

The Ross Patent, U.S. Pat. No. 2,631,883, discloses a handle for cans, which is made by wires that are shaped and welded together.

The Rice Patent, U.S. Pat. No. 2,088,387, discloses a bottle holder, which releasably grips the bottle containing a beverage.

The Heuther Patent, U.S. Pat. No. 2,838,202, discloses a handle and stand for cups, beverage cans, and the like.

These prior art devices contain some of the features of Applicant's invention, but do not collectively contain all of the features and the functional advantages associated therewith.

SUMMARY OF THE INVENTION

It is an object of this invention to provide a novel coaster and handle device which may be readily applied to and removed from a beverage can to facilitate drinking from the beverage can.

The novel one-piece, molded coaster and handle device for the beverage cans includes a coaster structure having a handle integral therewith and extending therefrom. The coaster structure includes a central flat support wall, which is connected to an annular outer wall, and these walls cooperate with each other to support the bottom portion of a conventional beverage can. The handle is comprised of a vertical handle element of uniform width, which is connected to a lower handle element that extends between and is integral with the coaster structure and the vertical handle element. A flat transversely extending support element is integral with the lower handle element and cooperates with the coaster structure to support the coaster and handle device upon a flat surface. The upper portion of the vertical handle element has a curved upper handle element integral therewith, which terminates in a terminal portion having a downwardly facing molded in slot provided with gripping elements to prevent slippage of the beverage can relative to the coaster and handle device.

FIGURES OF THE DRAWING

DESCRIPTION OF THE PREFERRED EMBODIMENT

Figure 1:
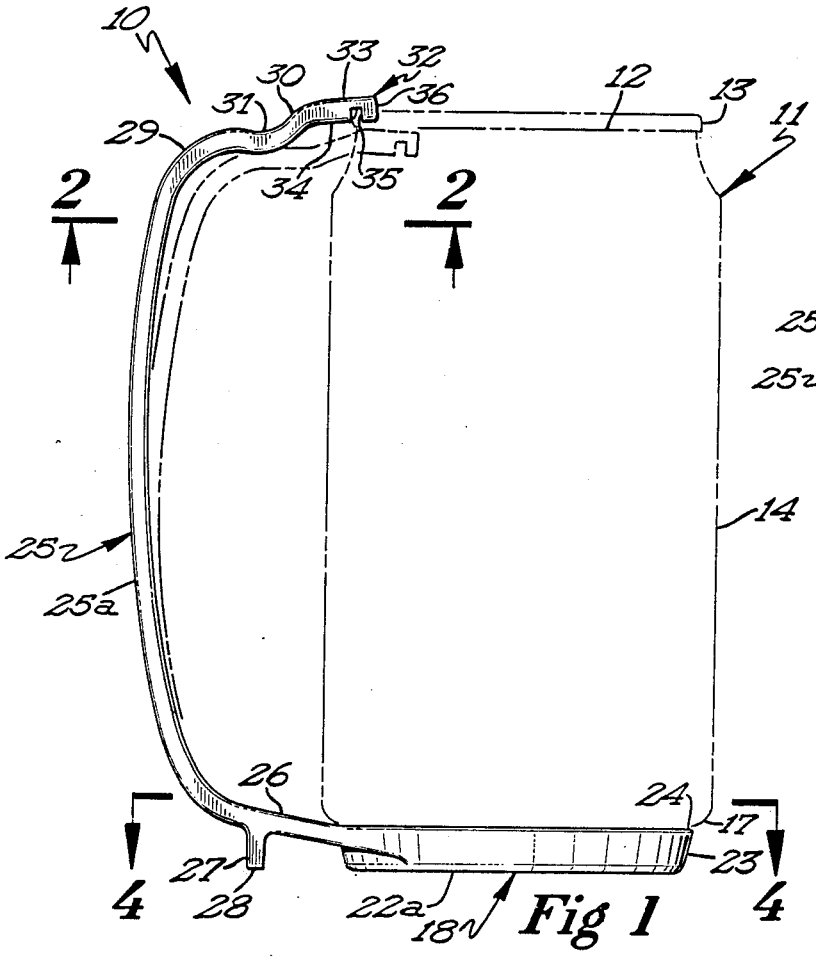
FIG. 1 is a side elevational view of the novel coaster and handle device, illustrated in full-line configuration in supporting relation to a can, and illustrated in a non-supporting position in dotted line configuration.

Referring now to the drawings and, more specifically, to FIG. 1, it will be seen that one embodiment of the novel coaster and handle device for beverage cans, designated generally by the reference numeral 10, is illustrated in attached relation to a conventional beverage can 11. The coaster and handle device 10 is molded into a single-piece construction and is preferably formed of suitable rigid plastic material, preferably high impact polystyrene. The beverage can 11, illustrated in supported relation with respect to the coaster and handle device 10, is preferably formed of aluminum or the like. The beverage can is of cylindrical configuration and includes a top wall 12 having an upper annular bead 13, which is integral with a cylindrical wall 14. The beverage can also has a bottom wall 15, which has a slight arc and is integral with a depending lower annular bead 16. The lower annular bead 16 is integral with an inwardly tapering portion 17, which extends from the cylindrical wall 14. The beverage can 11 will typically be provided with a pull tab for opening a can.

Figure 4:
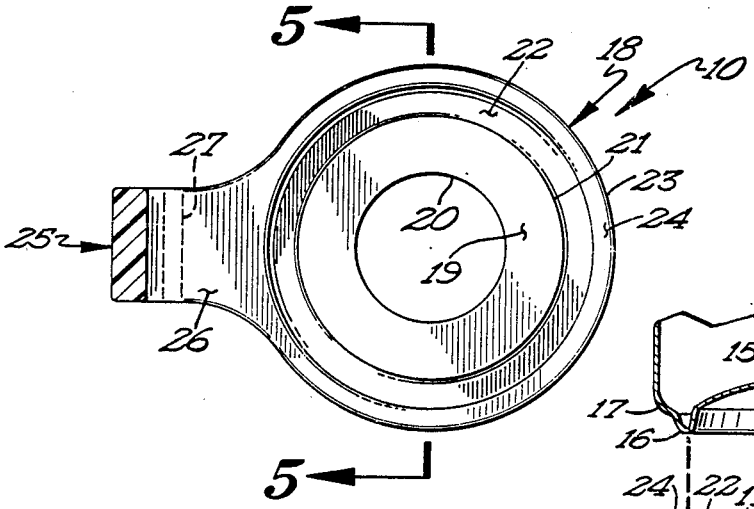
FIG. 4 is a cross-sectional view taken approximately along the line 4—4 of FIG. 1 and looking in the direction of the arrows.
Figure 5:
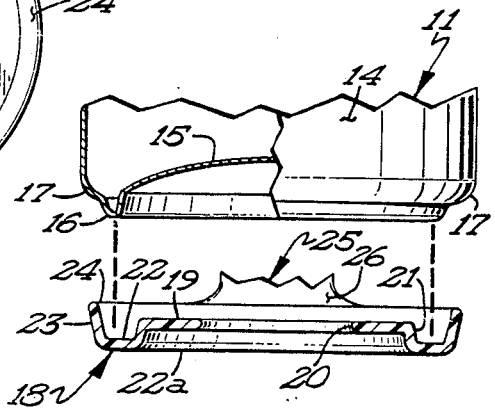
FIG. 5 is a cross-sectional view taken approximately along the line 5—5 of FIG. 4 and looking in the direction of the arrows.

The coaster and handle device 10 includes a coaster structure 18, which is comprised of a central flat support wall 19, as best seen in FIGS. 4 and 5, and which is of circular configuration, having a central opening 20 therein. The entire coaster structure 18 is of circular configuration, and the central opening 20 in the support wall 19 has a diameter less than one-half the diameter of the coaster structure 18. The flat central wall 19 has a depending annular wall 21 integral therewith and extending downwardly and slightly outwardly therefrom. The depending annular wall 21 is integral with an annular substantially flat bead supporting wall 22, which has a substantially flat lower surface **22*a* and a substantially flat upper surface 22*b* disposed substantially parallel to the upper surface of the central flat support wall 19. An outer annular wall 23 is integral with the bead supporting wall 22 and extends upwardly and outwardly therefrom. It will be seen that the upper edge surface 24 of the annular wall 23 is disposed in a plane parallel and spaced above the upper surface of the support wall 19**.

The coaster and handle device 10 also includes a generally C-shaped handle 25, which is integral with the coaster structure 18, and which projects outwardly and upwardly therefrom. The handle 25 includes a slightly curved vertical handle element **25*a*, which has a uniform width dimension and a uniform thickness dimension throughout its vertical extent. The handle 25 includes a lower curved handle element 26, which is integral with the vertical handle element 25*a* and with the coaster structure 18. It will be noted that the lower handle element 26 has the same thickness dimension as the vertical handle element 25*a*, but its width dimension flares slightly at its juncture with the coaster structure 18. A rectangular, substantially flat, transversely extending support element is integral with the lower handle element 26 and depends therefrom in outwardly spaced relation with respect to the coaster structure 18. The support element 27 also a width dimension corresponding to the width dimension of the vertical handle element 25 and is provided with a flat lower edge surface 27*a* that is disposed in the same horizontal plane as the lower surface 22*a* of the bead support wall 22**.

The handle 25 also includes an upper curved handle element 29, which is integral with the vertical handle element **25*a*, and which extends therefrom in substantially overlying relation with respect to the lower handle element 26. It will be noted that the upper handle element 29 has the same width dimension throughout its extent as the width dimension of the vertical handle element 25**.

Figure 2:
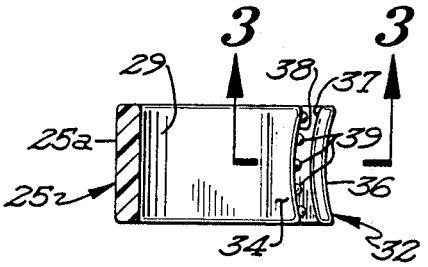
FIG. 2 is a cross-sectional view taken approximately along the line 2—2 of FIG. 1 and looking in the direction of the arrows.
Figure 3:
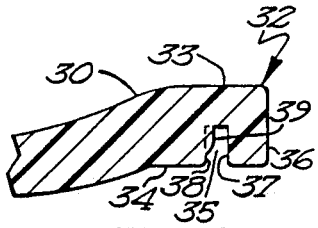
FIG. 3 is a cross-sectional view on an enlarged scale taken approximately along the line 3—3 of FIG. 2 and looking in the direction of the arrows.

The curved upper handle element 29 is shaped and configured to define an upwardly extending portion 30 to thereby define a thumb receiving recess 31. The upper handle element 29 also includes a terminal portion 32, which has a flat upper surface 33 and a flat lower surface 34. The terminal portion 32 has a downwardly opening transversely extending molded in slot or groove 35 that is of generally arcuate configuration, as best seen in FIG. 2, and which defines an outer lip 36, which is also of arcuate configuration. The slot 35 also defines an arcuate gripping surface 37 disposed in opposed relation to the inner surface **36*a* of the outer lip and provided with a plurality of small gripping elements 39**, which project outwardly therefrom.

The coaster and handle device 10 may be readily applied to and removed from a conventional can 11. When the coaster and handle device is applied to a beverage can, it serves to provide a coaster and handle for the beverage can. When so used with a conventional beverage can 11, the latter is positioned upon the coaster structure 18 so that the lower wall 15 thereof is supported on the flat support wall 19. When disposed in this position, the bead 16 may engage the upper surface **22*b* of the annular bead support wall 22, or, in some instances, the bead's lower edge surface will be spaced above this bead support surface. The upwardly flared annular wall 23 will extend around the inwardly tapering portion 17 of the can. The upper bead 13 will be received within the slot 35 and will be engaged by the gripping elements 39**.

Because the C-shaped handle 25 is of substantially uniform width and substantially uniform thickness, the upper and lower portions of the handle may be flexed when applied to a beverage can. It is preferred that the upper bead 13 be engaged in the slot 35 initially during application of the coaster and handle device to the can. The vertical spacing between the central support wall 19 and the depth of the slot 35 is slightly less than the vertical dimension of a conventional beverage can. The lower coaster structure may then be flexed downwardly to permit the can to be snapped in place between the coaster structure and the slotted upper handle element.

The curved or cambered configuration of the vertical handle element **25*a* facilitates flexing of the entire handle during application of the device to a beverage can. The gripping elements 39 will engage the upper bead of the can and prevent any movement of the can relative to the coaster and handle device so that the opening in the upper wall of the can will remain stationary. When the can is placed upon a surface, the lower substantially flat wall surface 22*a* of the flat bead supporting wall 22 and the lower surface 28 of the transverse support element will engage the surface. The location and transversely extending construction of the support element 27 permit the coaster and handle device to support in a stable condition a beverage can on a flat surface. The coaster structure 18** not only supports the can thereon, but prevents the moisture produced by sweating from a chilled can from damaging a support surface.

It will, therefore, be seen that I have provided a novel coaster and handle device, of simple and inexpensive construction, which functions in a more efficient manner than any other heretofore known comparable device.

What is claimed is:

1. A single-piece coaster and handle device molded from a rigid plastic material for ready attachment to a cylindrical beverage can having an upper wall, an upper annular bead integral with the upper wall, and a lower wall, said coaster and handle device comprising:

a generally circular coaster structure including a flat central support wall of circular configuration having a central opening therein and being of a size for supporting the lower wall of a beverage can thereon, an annular depending wall integral with said flat central support wall and depending therefrom, an annular substantially flat bead-supporting wall integral with said depending annular wall and extending outwardly therefrom, said flat bead-supporting wall integral with said depending annular wall and extending outwardly therefrom, said flat bead-supporting wall having a flat upper surface and a flat lower surface, an annular outer wall integral with said bead-supporting wall and extending upwardly and outwardly therefrom and having an upper edge disposed in a horizontal plane located above the flat central support wall, a generally C-shaped handle including a curved lower handle element integral with said coaster structure and extending outwardly and upwardly therefrom, a curved vertical handle element integral with said curved lower handle element and extending upwardly therefrom, a curved upper handle element integral with said vertical handle element and extending outwardly therefrom in substantially overlying relation with said curved lower handle element, said vertical handle element and said upper handle element being of uniform width, said upper handle element being shaped to define a thumb rest in the upper surface thereof to facilitate holding of said coaster and handle device by a user, said upper handle element including a curved portion and a terminal portion, said terminal portion having a width dimension corresponding to the width dimension of the vertical handle element, said terminal portion having flat upper and lower surfaces and having a downwardly facing, transversely extending arcuate slot therein to define an outer lip and an arcuate gripping surface opposed to said outer lip, said outer lip comprising the outer end of said terminal portion, said arcuate gripping surface having a plurality of gripping elements integral therewith and projecting outwardly therefrom towards said outer lip for gripping the upper bead of a beverage can projecting into said slot, and a flat rectangular-shaped support element integral with the curved lower handle element and extending transversely thereof, said support element being spaced outwardly of said coaster structure and having a width dimension corresponding to the width dimension of the vertical handle element and said upper handle element, said support element having a flat lower surface disposed in the same horizontal plane as the horizontal plane of the lower surface of said annular bead-supporting wall.

* * * * *